US005374119A

United States Patent [19]

Scheimann

[11] Patent Number: 5,374,119

[45] Date of Patent: Dec. 20, 1994

[54] METHOD AND APPARATUS FOR DISPERSING OR DISSOLVING PARTICLES OF A PELLETIZED MATERIAL IN A LIQUID

[75] Inventor: David W. Scheimann, Joliet, Ill.

[73] Assignee: Nalco Chemical Company, Naperville, Ill.

[21] Appl. No.: 116,037

[22] Filed: Sep. 2, 1993

Related U.S. Application Data

[63] Continuation-in-part of Ser. No. 905,722, Jun. 29, 1992, Pat. No. 5,253,937.

[51] Int. Cl.[5] ..... B01F 15/02; B01F 13/02

[52] U.S. Cl. ..... 366/101; 137/268; 366/136; 366/165; 422/263

[58] Field of Search ..... 366/136, 137, 163, 165, 366/3, 5, 10, 11, 101, 102, 103, 104, 105, 106, 107; 137/268; 134/93; 422/261, 263

[56] References Cited

U.S. PATENT DOCUMENTS 1,944,836 1/1934 Cowles .
2,387,945 10/1945 McDow .
2,469,825 5/1949 Hornstein .
2,997,373 8/1961 Stephens .
3,236,504 2/1966 Galer ..... 366/3
3,607,105 9/1971 Reid et al. .
4,199,001 4/1980 Kratz .
4,235,849 11/1980 Handeland .

OTHER PUBLICATIONS

Thomson, Fred M., E. I. du Pont de Nemours & co., "Feeders: Smoothing the Flow of Materials Through the Plant", Oct. 30, 1978, pp. 113–123.

*Primary Examiner*—Robert W. Jenkins
*Attorney, Agent, or Firm*—Lloyd L. Zickert; Robert A. Miller

[57] ABSTRACT

A method and an apparatus for dispersing or dissolving a pelletized material in a liquid, in which a pelletized material is placed on a platform in a container having a lower chamber portion, and a stream of liquid is introduced into that lower chamber to produce a vortex of the liquid which washes across the pelletized material, thereby causing it to become dispersed or dissolved into the liquid. In installations where the flow rate of the liquid is below a certain level, a supply of compressed air is injected into the liquid of the lower chamber to prevent mudding of the material.

32 Claims, 5 Drawing Sheets

Fig. 1
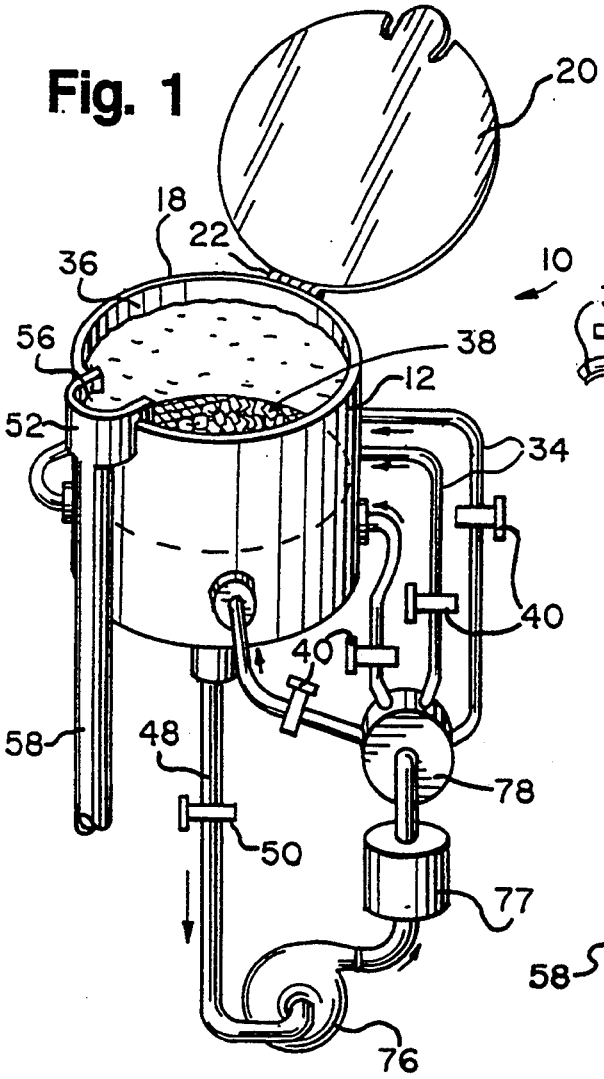
Fig. 2
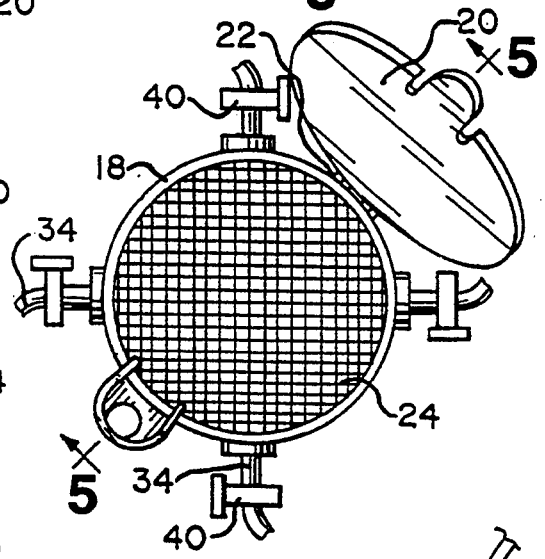
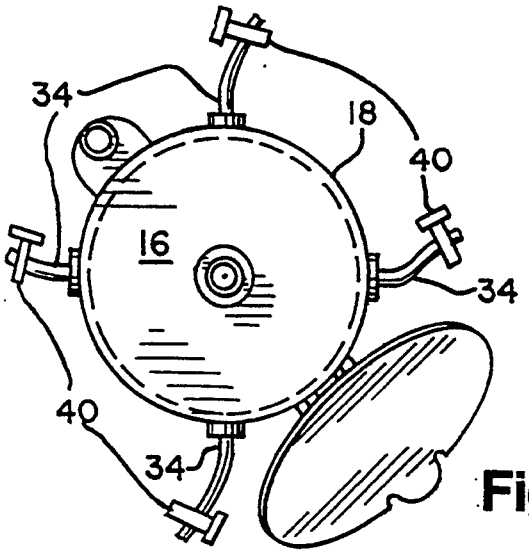
Fig. 3
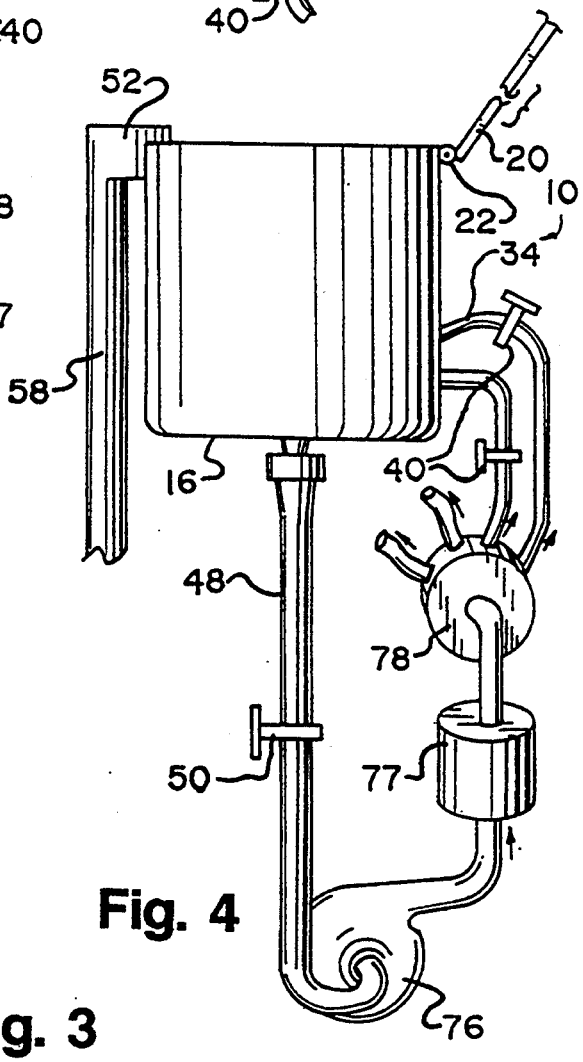
Fig. 4

Fig. 6
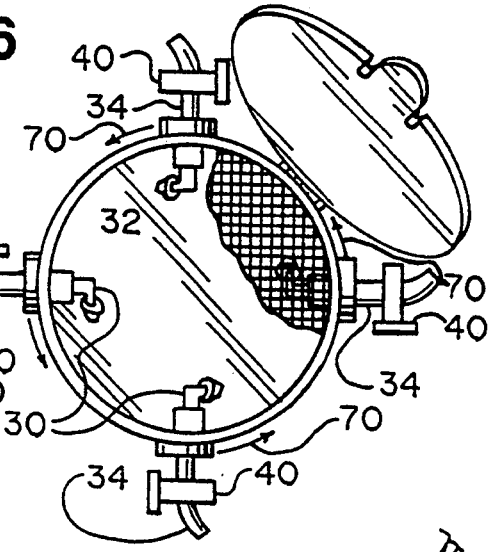
Fig. 7
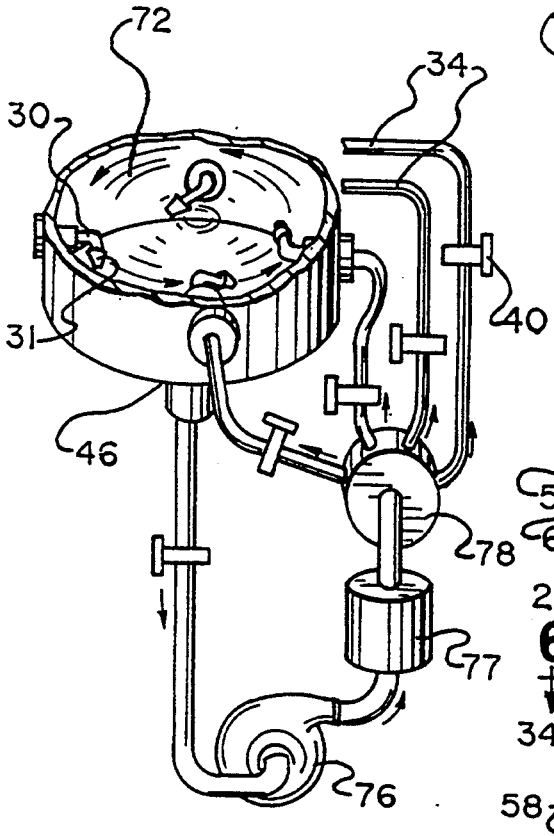
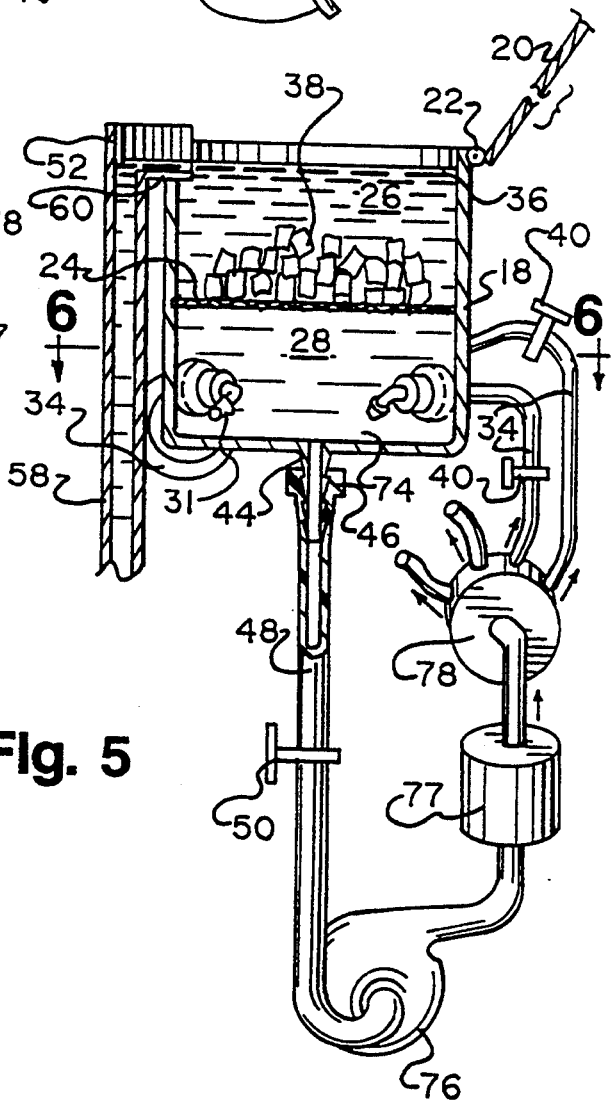
Fig. 5

Fig. 8
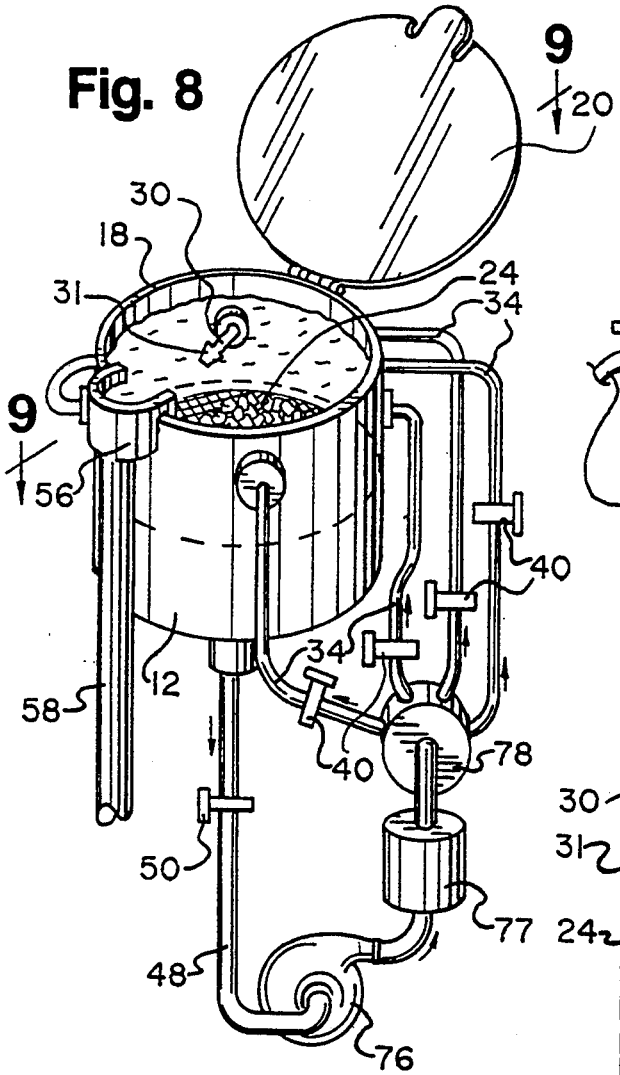
Fig. 10
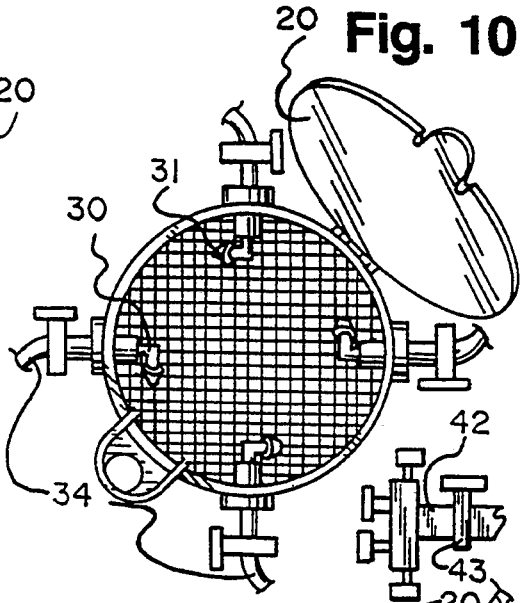
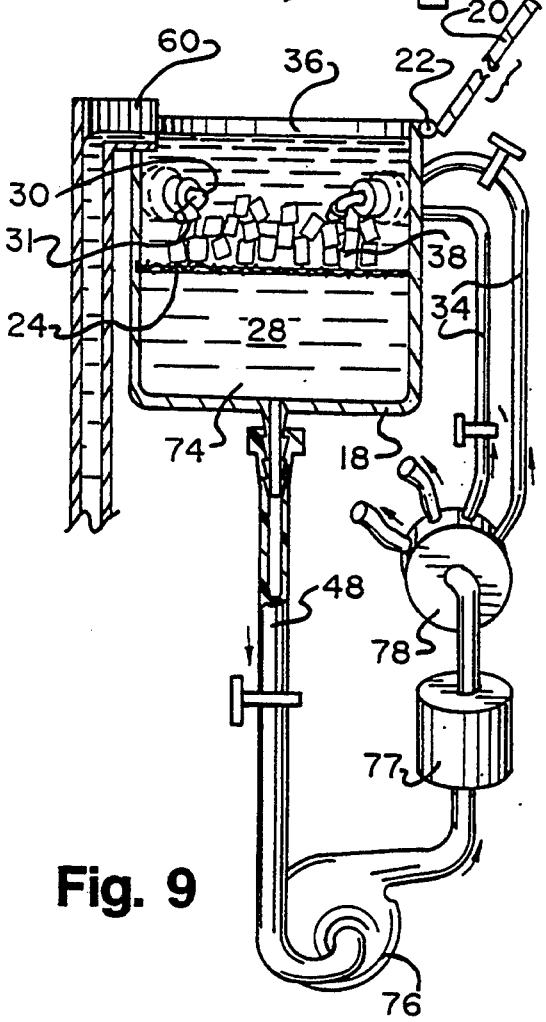
Fig. 9
Fig. 11
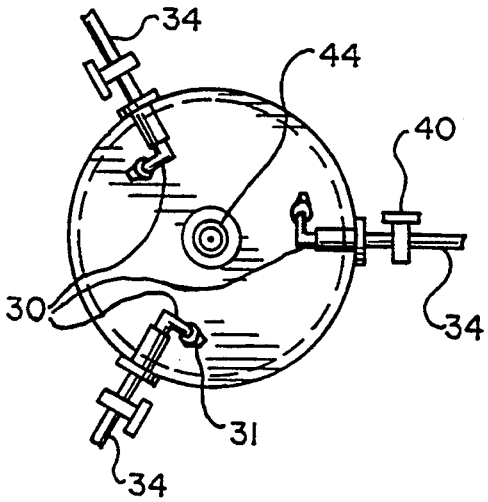

METHOD AND APPARATUS FOR DISPERSING OR DISSOLVING PARTICLES OF A PELLETIZED MATERIAL IN A LIQUID

This application is a continuation-in-part application of co-pending application Ser. No. 07/905,722 filed Jun. 29, 1992, now U.S. Pat. No. 5,253,937.

This invention relates in general to the disintegration and dispersion of pelletized materials in liquids, and more particularly to an improved method and an apparatus for disintegrating and dispersing a pelletized material in a liquid, and still more particularly to an improved method and apparatus for disintegrating and dispersing pelletized paint detackifier materials in water by providing a water flow into the container to impact on the material and a compressed air supply coacting with the water flow to disintegrate and disperse the material in the water.

BACKGROUND OF THE INVENTION

Chemical treatments are often prepared, transported and used in dry powder or granular form. Typically, such treatments must be dispersed or dissolved in water or other liquids before being used. Unfortunately, when dry powdered or granular chemicals are dispersed or dissolved, they often do not diffuse completely or uniformly throughout the liquid, and may settle in the mixing container and obstruct the supply and return lines. Particularly, dry detackifier products are often difficult to use in the field as wetting of the product and dispersion in paint spray booths recirculation water is difficult. This can result in undesirable variations in concentration, errors in treatment levels and equipment failure. Moreover, with the dry powdered products, the product is typically dispersed in a dry tank and slug fed or fed as a slurry using expensive metering pumps.

These and the other problems inherent in the use of dry powdered or granular chemicals may be avoided or reduced by forming the dry powdered or granular chemicals into pellets and then immersing the pellets in a liquid to gradually strip away and disperse or dissolve the chemicals. Currently available systems for achieving this end are often large, complex, and expensive and do not produce consistent results.

For example, in one common system, pelletized materials are suspended in a quiescent liquid reservoir to slowly break up and disperse or dissolve the pellets, producing a mixture which may be used as desired. In other currently available systems, referred to as "pot feeders" and "by-pass feeders", one or more jets or currents of water are directed parallel to the vertical axis of the reservoir, to pass directly into and through the pelletized materials. These systems, unfortunately, are not as efficient as desired to completely dissolve and disperse many pelletized materials.

SUMMARY OF THE INVENTION

The present invention provides an improved method and an apparatus for dispersing and dissolving pelletized materials in liquids, in which the pelletized materials are placed in a container. A stream of liquid is introduced to produce a vortex which washes against the pelletized material causing the particles of the pelletized material to become dispersed or dissolved in the liquid, and the resulting dispersion or solution is removed from the container.

In one preferred embodiment of the invention, the apparatus includes a cylindrical container which is used to hold water and a solid pelletized chemical. The container comprises upper and lower chambers separated by a mesh screen or platform to hold the pellets. A plurality of liquid injection ports are arranged to produce a vortex which rises from the lower chamber to wash against the pellets. The injection ports are fed by liquid supply conduits, and the container has a liquid overflow outlet as well as a liquid distribution outlet for draining off the dispersion or solution which is produced by the apparatus.

When operating the invention, the pelletized chemical is placed onto the platform and the container is filled with liquid which enters through the ports. As the liquid enters the container, the force of the water exiting the ports, as directed by the positioning of the ports, causes the liquid to swirl within the container, creating a vortex which washes past the surface of the pelletized material. This swirling action breaks particles away from the surface of the pellets. These freed particles are dispersed or dissolved into the liquid by the moving stream. The resulting mixture is then removed from the container and applied as desired.

In one preferred embodiment, the invention is used with a paint spray booth system as a paint detackifier feeder. In this application, water is forced into a container holding pelletized detackifier which breaks up and disperses throughout the water. The resulting water/detackifier dispersion is then removed from the container and transported to the paint spray booth system. As the water/detackifier mixture is removed, additional water is pumped into the container from the main water reservoir of the paint spray booth continuing the dispersal of the detackifier which is continuously returned to the paint spray booth to react with the paint droplets or particles, surrounding them and making the paint non-tacky.

A novel feature of the above embodiment of the invention is that the apparatus utilizes the recirculation pump of the paint spray booth system (or other chemical treatment system), and therefore does not itself require any moving parts. Of course, in some applications a dedicated pump may be required. In addition, the system continuously recirculates resulting in a continuous flow of the liquid, a uniform break-up of the pelletized material, and a reliable chemical feed.

In another embodiment where the water flow rate to the container is less than 4.5 gallons per minute (gpm), a supply of compressed air is introduced into the container to coact with the water flow to prevent mudding of the pelletized material and assure proper disintegration of the material in the water.

Accordingly, an object of the present invention is to provide an improved method and apparatus for dispersing or dissolving particles of a pelletized material in a liquid.

Another object of the present invention is to provide a method and apparatus for accurately controlling the rate at which a pelletized material is dispersed or dissolved in a liquid.

A further object of the present invention is to provide a method and apparatus for regulating the distribution of a liquid having particles of a pelletized material suspended therein.

Yet another object of the present invention is to provide a highly reliable method and a low cost and low maintenance apparatus for dispersing or dissolving particles of a pelletized material in a liquid which, itself, requires no moving parts.

A still further object of the present invention is to provide an improved method and apparatus for disintegrating and dispersing pelletized material in water where the water flow rate is less than 4.5 gpm, which includes the use of a compressed air supply to coact with the water flow rate and avoid mudding of the material.

Other objects, features and advantages of the invention will be apparent from the following detailed disclosure, taken in conjunction with the accompanying sheets of drawings, wherein like reference numerals refer to like parts.

BRIEF DESCRIPTION OF THE DRAWINGS

FIG. 1 is a perspective view of a preferred embodiment of the invention, depicting the container of the invention filled with a liquid and a pelletized material;

FIG. 2 is a top plan view of the embodiment of FIG. 1, depicting a reticulated platform inside the container;

FIG. 3 is a bottom plan view of the embodiment of FIG. 1, depicting liquid supply hoses, a distribution tube and an overflow return tube;

FIG. 4 is an elevational view of the embodiment of FIG. 1 of the invention;

FIG. 5 is a cross-sectional view, taken along line 5—5 of FIG. 2;

FIG. 6 is a cross-sectional view, taken along line 6—6 of FIG. 5, depicting liquid injection nozzles, a bulkhead fitting, and the overflow return tube;

FIG. 7 is a cut-away perspective view of the embodiment of the invention of FIG. 1, depicting the liquid injection nozzles creating a vortex within the container;

FIG. 8 is a perspective view of an alternative embodiment of the invention depicting the liquid supply hoses and liquid injection nozzles located above the reticulated platform;

FIG. 9 is a cross-sectional view, taken along line 9—9 of FIG. 8;

FIG. 10 is a perspective view of the embodiment of FIG. 8, depicting the liquid supply hoses connected to a main supply hose;

FIG. 11 is a perspective view of an alternative embodiment of the invention, depicting liquid supply hoses having a single liquid supply adjustment valve;

DESCRIPTION OF THE INVENTION

Figure 12:
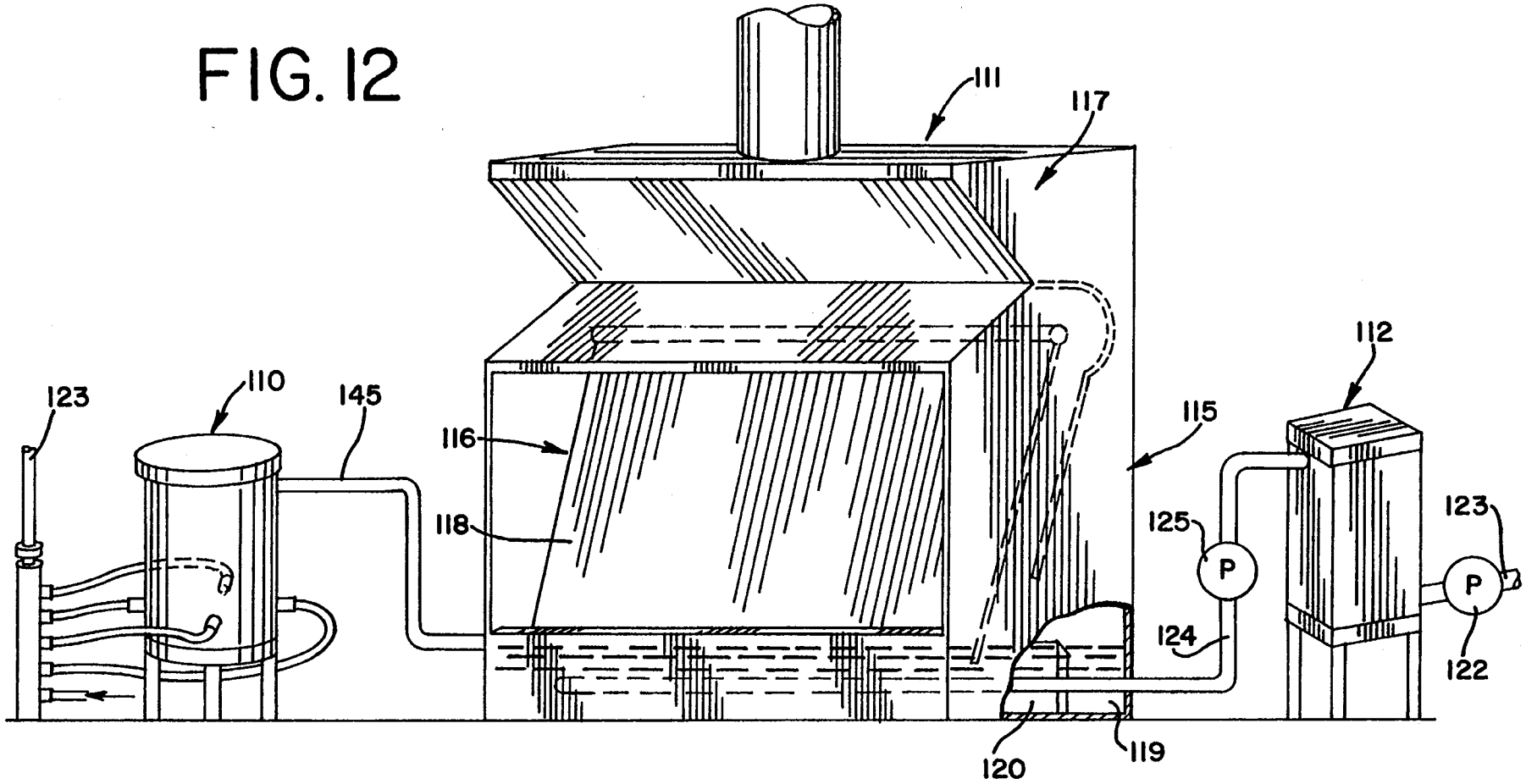
FIG. 12 is a diagrammatic view of a paint spray booth with the improved feeder of the present invention that is a modification of the feeders previously illustrated.

While the description below refers to a paint detackifier feeder, the invention is not intended to be limited to that embodiment and should be construed as extending to any application in which a pelletized chemical, in ball, stick, tablet or other shape, is to be dissolved or dispersed in a liquid.

Turning now to FIGS. 1, 2 and 5, the apparatus of the invention 10 includes a container 12 having a generally cylindrical body including a base 16, a continuous cylindrical side 18, and a cover 20 connected to the container 12 by a hinge 22. Container 12 comprises upper and lower chambers 26 and 28 separated by a sieve-like or reticulated platform 24 holding paint detackifier pellets 38. Although it is preferred that the container be cylindrical, as illustrated, other shapes may be used so long as dead zones are avoided by properly positioning the ports (discussed below) to prevent sediment build-up in corners.

As best seen in FIGS. 5 to 7, four injection ports 30 are mounted within the lower chamber 28 of container 12 by mounting brackets 32 and fed by four corresponding liquid supply hoses 34 mounted near the base 16 of the container 12. Injection ports 30 are fitted with "full stream" or "solid stream" nozzles 31 to focus the liquid stream and interconnected with each other by conduits 34 which are in communication with an external pump which supplies liquid under pressure to the apparatus. In alternate embodiments of the invention, the ports may be simply appropriately sized orifices. In the illustrated embodiment, container 12 is about 35 inches tall and about 13 inches in diameter, supply hoses 34 have a $\frac{1}{2}''$ i.d., nozzles 31 have a $\frac{1}{4}''$ i.d., and the external pump produces between about 20 and 80 psi. These parameters will, of course, be adjusted on an application-by-application basis to satisfy the unique requirements of any given application.

As seen in FIG. 2, liquid supply hoses 34 include adjustment valves 40 which allow the user of the apparatus to regulate the amount of water 36 being supplied to apparatus 10. In alternative embodiments of the invention, conduits 34 may branch off central conduit 42, which includes a main adjustment valve 43 (FIG. 10), or conduits 34 may only include one adjustment valve 40 on a single hose (FIG. 11).

FIGS. 3, 5 and 7 illustrate a main distribution outlet 44 interconnecting the container 12 and the paint spray booth's pumping system 76. The distribution outlet 44 comprises a bulkhead fitting 46 and a distribution hose 48 having a distribution adjustment valve 50. The distribution hose 48 is interconnected to pump 76 which supplies the water/detackifier to the paint spray booth 77. The distribution adjustment valve 50 allows the user to regulate the amount of water/detackifier mixture which is being drawn by pump 76 from apparatus 10 for use in the paint spray booth. Also, coordinated adjustment of valves 40 and 50 allows the user to regulate the concentration of detackifier 38 within the water, as discussed below.

Apparatus 10 further includes a liquid overflow outlet 52 mounted to side 18 of container 12 near the upper portion of chamber 26. Outlet 52, which is interconnected between the container 12 and the detackifier water reservoir of the paint spray booth system (not shown), serves to relieve overflow from container 12. Overflow outlet 52 includes an overflow trough 56 and an overflow return hose 58 which extends downwardly from the base 60 of the trough 56 externally along side 18 of the container 12.

When apparatus 10 is activated, water 36 from the detackifier water reservoir of the paint spray booth is pumped through the liquid supply hoses and into container 12 through liquid injection ports 30. Nozzles 31 of injection ports 30 are positioned so that the water is injected along line 70 which is tangential to the inner surface of the container. Additionally, the ports are positioned at an angle of about 45 degrees below the horizontal so that the water streams strike base 15 of container 12. This angle may be increased toward the vertically downward position or decreased toward the horizontal, so long as the parameters of flow rate, number and positioning of ports, etc. can be adjusted to prevent the formation of dead zones without water movement at the bottom of the container which would otherwise permit undesirable sediment build-up.

The positioning of nozzles 31 creates a vortex of water 36 within the container 12, which washes over the detackifier pellets 38 resting on platform 24 in container 12 (FIG. 7), causing them to disintegrate and dissolve or disperse into the water either immediately or as the released particles 74 continue to be buffeted by the vortex.

The resulting water/detackifier mixture then drains from the container through bulkhead fitting 46 of the liquid distribution outlet 44 and into liquid distribution hose 48, where it is carried away to the paint spray booth's pumping systems. There the mixture is pumped into a cascade of water where the detackifier reacts with the paint by surrounding the free paint particles, facilitating removal of the paint from the system. At least a portion of the detackified paint may then be removed from the system. In any event, a portion of the pressurized flow to the paint spray booth is drawn off, as shown schematically at 78, and returned to container 12 by way of liquid supply hoses 34.

Liquid adjustment valves 40 on the liquid supply hoses 34 may be adjusted to regulate the rate of flow of the water into container 12. This will increase or decrease the force of vortex 72, thereby increasing or decreasing the rate at which the pellets disintegrate and the detackifier particles 74 are dissolved or dispersed into Water 36, and enabling the level or concentration of detackifier in the system to be adjusted as desired.

Finally, the volume of water being supplied to the container may be greater than the volume being drawn from the container through the distribution outlet. When this is the case, the excess will be removed from the container 12 through overflow outlet 52. This excess spills over into trough 56 and is carried away from container 12 to the water reservoir of the paint spray booth (not shown), where it is once again pumped back into the container via the liquid supply hoses 34. Additionally, overflow outlet 52 relieves overflow if the distribution outlet becomes obstructed by the pelletized material or any other substance.

As seen in FIGS. 8 and 9, in an alternate embodiment of the invention, liquid injection ports 30 and liquid supply hoses 34 may be located in upper chamber 26 of the container 12. In this embodiment, ports 30 are angled about 70 degrees below the horizontal, thus creating a slower moving vortex than in the preferred embodiment. In other embodiments of the invention, the number of ports, as well as the angle of incidence, may be increased or decreased (to as few as one), thereby creating a vortex which may be shallower and having a lesser agitation of fluid, or deeper with greater agitation of fluid. In yet another embodiment of the invention, at least two sets of nozzles are provided, one in the container's upper chamber and the other in the container's lower chamber.

The embodiment shown in FIGS. 12 and 13 differs from the previous embodiments in that the problem of mudding of the pelletized material where the water-flow rate is below 4.5 gpm is solved by the additional use of compressed air to cause proper disintegration of the pelletized material. More particularly, during the field-testing of the feeder previously described, it was discovered that in water recirculation systems for paint spray booths, where the water supply to the feeder was limited to 4.5 gallons of water per minute or less, there was not sufficient agitation of the water within the feeder to remove all of the disintegrated material from the surface of the pellets. This caused mudding of the material and reduced disintegration, resulting in producing a solution inadequate to properly detackify the paint overspray. The mudding effect was overcome by the injection of compressed air in the water prior to the water being injected into the feeder tank wherein the compressed air coacts with the water to provide additional agitation which will remove the material from the pellet surface. While it is preferable to inject the air into the water prior to the water being introduced into the feeder tank, air may be injected directly into the feeder tank. Further, the mesh screen used in the bottom of the tank for suspending the pelletized material aids in dispersing the air and creating additional agitation around the pellets. While this air injection method is less desirable, it is still effective in reducing the mudding effect. It will be appreciated that where reduced disintegration rates of product result from a low water flow rate through the feeder, insufficient chemical is added to the system to treat the system properly. Further, reduced disintegration rates may cause plugging of the feeder and excessive product accumulations in the region between the screen and the tank bottom.

More particularly, it was found where in a system for feeding the detackification solution to a paint spray booth the water flow rate of 2.5 gpm was not sufficient to produce the agitation in the feeder to carry loose material away from the pellet surface and allow continuous disintegration of the remaining product. To overcome this problem a regulated compressed air line was connected to the water distribution manifold to produce additional agitation in the feeder and result in uniform product disintegration and elimination of the mudding effect.

Since compressed air is always available in a plant where paint spray booths are operated, the use of compressed air does not create any hardship on the user of the feeder. The feeder of the present invention is particularly useful for water wash paint spray booths used in the spray painting of parts where the water is to be treated for collecting the pigment and organic components of the paint and condition these components so they are not tacky, thereby producing a sludge which can be readily handled without sticking to the scrapers or flights of a sludge recovery apparatus.

In a water wash paint spray booth the paint overspray is directed against a water curtain descending into a sump. The water is recirculated to the sludge recovery unit, and from there it can be connected to the feeder of the invention so that the water can be treated with a detackifier agent and then discharged to the clean water sump area of the paint spray booth. The treated water in the clean water sump is then used to produce the water curtain. In order to maintain an optimum pH in the spray booth water to insure optimum performance, pH pellets are periodically added to a highly turbulent area of the spray booth water where they quickly dissolve to buffer the booth water to the desired pH.

One satisfactory dry detackifier pellet is manufactured by Nalco Chemical Company of Naperville, Ill., and is designated Nalco GI-8012. This pellet weighs about one-half pound, is cylindrical in shape with a diameter of about two inches and a height of about 2.5 inches. However, the height may be of the range of about 2.5 to three inches. A satisfactory pH pellet for this system is manufactured by Nalco Chemical Company under the designation Nalco GI-8014, and weighs about 0.124 pounds with a height of about 1.25 inches and a diameter of about 1.5 inches.

The disintegration rate of the detackifier pellets in the feeder depends solely upon the water flow rate through the unit. These pellets will not dissolve completely in stagnant water; they will take approximately five to eight hours to disintegrate completely in a feeder having a water flow rate of 9 gpm. Preferably, the pH pellets are placed in an area of high water flow and agitation in the main spray booth outside an area where they may be encapsulated in sludge. The pellets should not be placed in the pellet feeder with detackifier pellets.

Referring now to FIG. 12, the feeder of this embodiment is generally designated by the numeral 110 and illustrated diagrammatically as being connected to a paint spray booth 111 and a sludge recovery unit 112.

In general, the paint spray booth includes a housing 115 having a front opening 116, an upper exhaust hood 117, a downwardly and forwardly inclined water curtain panel 118 for forming a water curtain, a clean water sump 119, and a dirty water sump 120. The water curtain formed by the wall 118 descends over the wall and into the dirty water sump 120. Water from the clean water sump 119 is pumped up to the top of the water curtain forming wall and sprayed from a nozzle so as to form the water curtain and also serve to scrub the air exhausting from the booth. The structure and operation of the paint spray booth is well known and described in greater detail in the "Nalco Water Handbook," Second Edition, 1988, pages 25.9 to 25.11.

The feeder 110 of the invention is connected to the paint spray booth to deliver detackified water to the clean water sump 119, while the sludge recovery unit 112 is connected to the paint spray booth for receiving water from the dirty water sump 120. Further, the water from the sludge recovery unit, after the sludge has been removed, is recirculated to the feeder 110 by water recirculating pump 122 through line 123 which interconnects with the sludge recovery unit. Dirty water from the dirty water sump 120 is delivered to the sludge recovery unit 112 through line 124 and by pump 125. It will be appreciated that any number of regulating valves may be provided for regulating the flow between the feeder, the paint spray booth, and the sludge recovery unit, as well as from the sludge recovery unit to the feeder, as referred to in the earlier embodiments. In installations not including a sludge recovery unit, the water supply to the feeder may be provided by the water pump for the water curtain.

The feeder 110 includes a feeder tank or container 128 having a bottom wall 129 and a side wall 130. A cover 131 is provided at the top of the tank. The tank as illustrated is cylindrical in shape, but it will be appreciated that it could be of any desired shape that will accomplish the required material disintegration. Within the tank a mesh screen or perforated plate 132 is suitably supported in spaced relation above the bottom wall 129 and which is water-permeable, so that water coming into the lower part of the tank can move upwardly through the mesh screen 132 on which is supported the pelletized material 134. As already explained, the pelletized material comprises a plurality of pellets of whatever chemical is desired for treating the water, and in connection with a paint spray booth, the pellets would be a detackifying pellet as above described.

As in the previous embodiments, the water is supplied to the tank 128 through a plurality of nozzles 136 arranged in the bottom of the tank below the permeable support 132. These nozzles serve to direct the water in a fashion to cause agitation of the water as it moves upwardly through the permeable support 132 to wash over the pelletized material and cause stripping of the material into the water to produce the water treatment solution. Further, the nozzles may be of whatever desired size and configuration to produce the desired agitation of the water. In the embodiment illustrated, four nozzles are provided, each of which is connected by lines **136*a* to a water manifold 138, which in turn is connected to line 123 of the recirculation system. It will also be appreciated that the tank may be suitably supported on the floor or on a table 140** as illustrated to provide it at the proper height for operation in the system.

Figure 13:
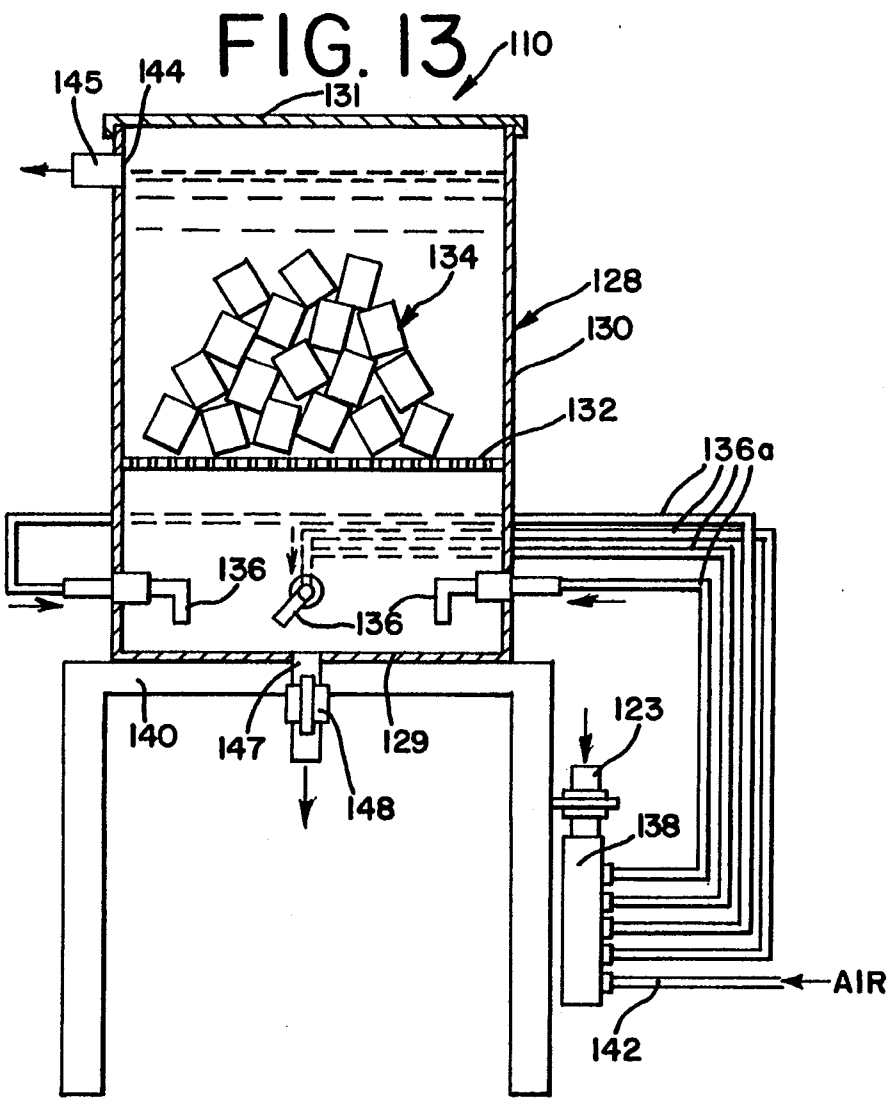
FIG. 13 is a sectional view of the feeder of FIG. 12 which is somewhat diagrammatic and showing the air connection at the intake water manifold.

In the embodiment of FIG. 13, a regulated compressed air supply is also injected into the water in the water manifold 138 through line 142. As above indicated, the compressed air may range from 2 to 10 psi, and preferably from 2 to 4 psi.

The tank 128 includes an outlet 144 connected to a line 145 that in turn is connected to the clean water sump 119 of the paint spray booth. The outlet 144 constitutes a gravity overflow of the solution in the tank for supplying the clean water area 119 of the paint spray booth. In the bottom wall 129 of the tank, a drain line 147 and a drain valve 148 are used principally during maintenance periods for draining the tank to allow easy inspection of the pellets and the inside of the feeder tank.

In operation, the recirculation water of the system is introduced to the water manifold 138 through the line 123 for distribution through the individual lines **136*a* of the water nozzles 136 so that the water can be introduced into the tank at the lower end and in agitated condition in order to assist in disintegrating the pelletized material. Additionally, the compressed air is injected into the water at the manifold to aerate the water and serve to provide additional agitation in the tank to enhance the disintegration of the pelletized material into the water. The air bubbles rise in the tank and can be again broken up by the mesh screen 132 and further pass over the pelletized material with the water in order to prevent mudding where the recirculation water flow rate is below 4.5 gpm. Then the solution produced by the disintegration of the pelletized material into the water is discharged from the tank in the overflow outlet 144 to go into the discharge line 145 and into the clean water sump area 119** of the paint spray booth. The size of the tank may be anywhere from 5 to 15 gallons and the temperature of the water in the system is room temperature. It will be appreciated that the number of nozzles, the water pressure, the velocity of the water, the air pressure, and the directional streams created by the nozzles and their location are such as to produce sufficient agitation around the pellets with the compressed air to cause exterior disintegration of the pelletized material for dispersing the pelletized material into the water in a uniform manner so as to produce a water solution for providing proper paint detackification. It will be further appreciated that the air bubbles injected into the water will sometimes split, and when that happens, it will cause water movement intended to loosen the material on the exterior of the pellets so as to properly and uniformly disintegrate the pellets and keep the solution at a chemical dosage level sufficient to handle the paint overspray in the paint spray booth.

Figure 14:
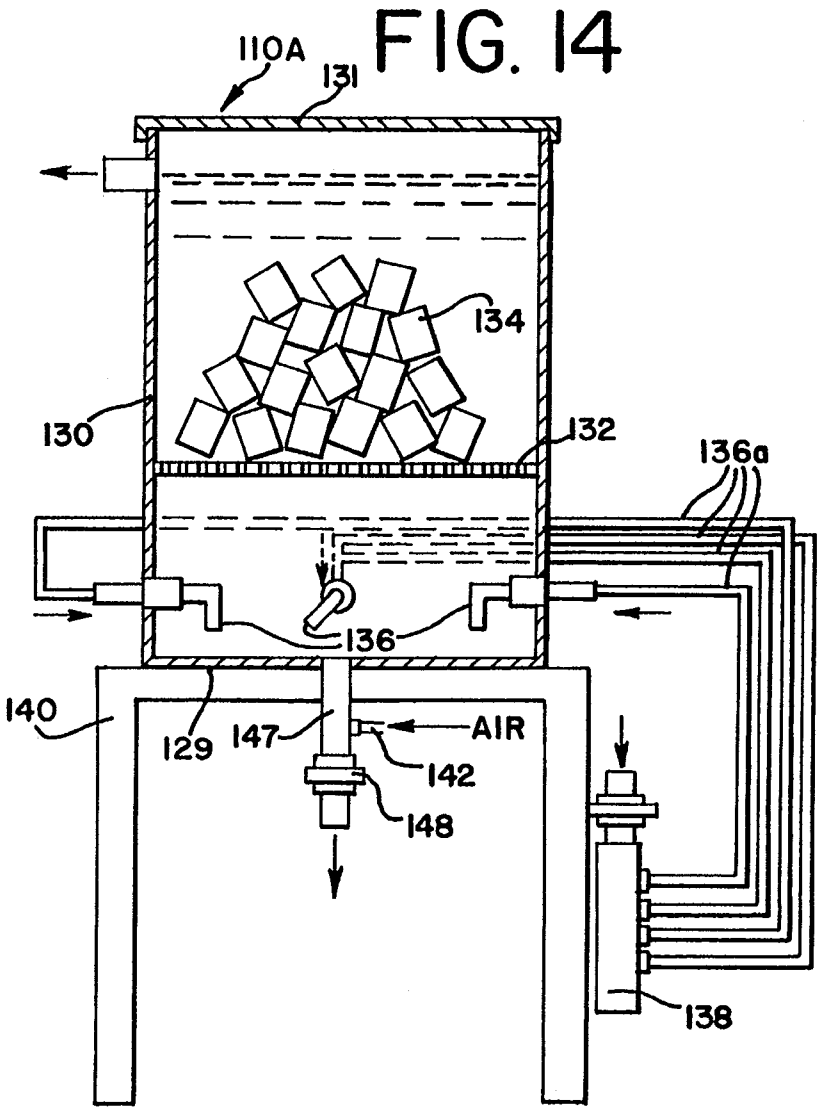
FIG. 14 is a view similar to FIG. 13, except showing the air connection at the bottom of the feeder tank.

While the embodiment of FIG. 13, where the air is injected into the water manifold 138 is the preferred embodiment, it will be appreciated that air can also be injected into the water in the bottom of the tank. FIG. 14 illustrates a further embodiment, generally designated by the numeral 110A, wherein the air line 142 is connected to the drain line 147 above the valve 148 so that the air is injected into the water in the area below the pelletized material support 132 before coacting with the water to enhance the disintegration of the pelletized material 134 on the support 132. It will be appreciated that the air supply may be injected into the water and any part of the lower part of the tank other than the drain line if that is convenient. It will also be appreciated that the air line will be fitted with a backflow preventer valve to prevent water from backing into the air line.

Accordingly, it will be appreciated that where the water recirculation rate is 4.5 gpm or less, it is necessary to additionally inject a compressed air supply into the water at the feeder tank in order to prevent mudding of the pelletized material and to provide uniform disintegration of the material to satisfy the paint detackification needs in a paint spray booth.

It will be understood that modifications and variations may be effected without departing from the scope of the novel concepts of the present invention, but it is understood that this application is to be limited only by the scope of the appended claims.

IMPROVED METHOD AND APPARATUS FOR DISPERSING OR DISSOLVING PARTICLES OF A PELLETIZED MATERIAL IN A LIQUID

The invention is hereby claimed as follows:

1. An apparatus for producing and feeding a chemical treatment solution to a process comprising, a feeder tank having bottom and side walls, a water-permeable support member in the tank spaced upward of the bottom wall for supporting pelletized chemical material, a plurality of nozzles in the container below the support member, said nozzles being connected to a supply of water to produce turbulent or agitated water in the tank, air supply means for aerating the water below said support means to coact with the turbulent water and gradually disintegrate the pelletized material in the water and produce the chemical treatment solution, and an outlet for discharging the solution from the tank to the process.

2. The apparatus of claim 1, which further includes a water distribution manifold, said water supply being connected to the manifold, means connecting said nozzles to said manifold, and means connecting the air supply means to said manifold.

3. The apparatus of claim 1, which further includes a water distribution manifold, said water supply being connected to the manifold, means connecting said nozzles to said manifold, and means connecting the air supply means directly to the tank for introducing the air below said support member.

4. The apparatus of claim 1, wherein said outlet is adjacent the top of the tank.

5. The apparatus of claim 1, wherein the supply of water has a flow rate of less than 4.5 gallons per minute.

6. The apparatus of claim 5, wherein the air supply is 2–10 psi.

7. The apparatus of claim 6, wherein the water supply is room temperature.

8. The apparatus of claim 7, wherein the pelletized material is dry paint detackifier pellets.

9. The apparatus of claim 8, wherein the pellets are cylindrically shaped.

10. The apparatus of claim 9, wherein the pellets are about 4 to 8 ounces by weight.

11. The apparatus of claim 9, wherein the pellets are about 2 inches in diameter and 2.25 to 3 inches high.

12. The apparatus of claim 9, wherein the pellets are about 2 inches in diameter and 2.25 inches high.

13. The apparatus of claim 5, wherein the air supply is 2–4 psi.

14. The apparatus of claim 1, wherein the support member is a mesh screen.

15. A method of producing and feeding a chemical solution for a process comprising the steps of:

providing a tank having bottom and side walls, providing pelletized material in the tank, supporting the pelletized material in the tank above the bottom wall on a water-permeable support member, feeding water into the tank below the support member through nozzles to produce turbulent or agitated water, feeding air into the tank below said support member to coact with the turbulent water and cause disintegration of the pelletized material and dispersion in the water to produce a chemical solution, and discharging the solution from adjacent the top of the tank to the process.

16. The method of claim 15, wherein the step of feeding air into the tank includes introducing the air into the water fed to the nozzles.

17. The method of claim 16, wherein the support member is mesh screen.

18. The method of claim 15, wherein the step of feeding air into the tank includes introducing the air into the tank below the pelletized material.

19. The method of claim 15, wherein the step of feeding water into the tank through nozzles includes providing a water distribution manifold outside the tank, connecting a water supply to the manifold, and connecting the nozzles in the tank to the manifold.

20. The method of claim 19, wherein the step of feeding air into the tank includes connecting a compressed air source to said manifold thereby injecting the air into the water at the manifold.

21. The method of claim 19, wherein the step of feeding air into the tank includes connecting a compressed air source directly to the tank for injecting the air into the water below the support member.

22. The method of claims 20 or 21, wherein the step of feeding air includes regulating the compressed air to be 2–10 psi.

23. The method of claims 20 or 21, wherein the step of feeding air includes regulating the compressed air to be 2–4 psi.

24. The method of claim 15, wherein the step of providing pelletized material includes providing cylindrically shaped pellets.

25. The method of claim 24, wherein the pellets are about 2 inches in diameter and 2.25 to 3 inches long.

26. The method of claim 24, wherein the pellets are about 2 inches in diameter and 2.25 inches long.

27. The method of claims 25 or 26, wherein the pellets are dry detackifier pellets.

28. The method of claims 25 or 26, wherein the pellets are about 4 to 8 ounces by weight.

29. A method of producing a chemical solution in a feeder tank having side and bottom walls for a process from pelletized material and water wherein the water flow rate of a water supply is limited to 4.5 gallons per minute or less, said method comprising:

supporting pelletized material in the tank above the bottom wall on a water-permeable support, connecting the water supply to a water distribution manifold, providing a plurality of water nozzles in the tank below said support, connecting the nozzles to the manifold, injecting compressed air into the water below the support, whereby the water and air coact to produce agitation for disintegrating the pelletized material in the water thereby producing the chemical solution, and discharging the solution from the tank to the process.

30. The method of claim 29, wherein the step of injecting compressed air into the water includes connecting an air supply to the manifold to inject the air into the water ahead of the nozzles.

31. The method of claim 29, wherein the step of injecting compressed air into the water includes connecting an air supply directly to the tank for injecting the air into the water below the support.

32. The method of claims 30 or 31, wherein the compressed air is regulated to about 2–4 psi.

* * * * *